US005454552A

United States Patent [19]

Boiteux

[11] Patent Number: 5,454,552

[45] Date of Patent: Oct. 3, 1995

[54] ARTICULATED FASTENING ELEMENT

[76] Inventor: Christophe Boiteux, Landresse, 25530 Vercel, France

[21] Appl. No.: 171,517

[22] Filed: Dec. 22, 1993

[30] Foreign Application Priority Data

Dec. 24, 1992 [FR] France ..... 92 15974

[51] Int. Cl.[6] ..... B25B 11/00

[52] U.S. Cl. ..... 269/21

[58] Field of Search ..... 269/21, 310, 316, 269/108; 51/235; 279/3; 248/362, 363; 294/64.1

[56] References Cited

U.S. PATENT DOCUMENTS

| | | | |
|---|---|---|---|
| 3,307,249 | 3/1967 | Hohoff | 29/235 |
| 3,652,075 | 3/1972 | Thompson | 269/21 |
| 3,676,940 | 7/1972 | Shively | 248/362 |
| 4,138,080 | 2/1979 | Albert | 269/21 |
| 4,470,585 | 9/1984 | Bavelloni | 269/21 |
| 4,561,642 | 12/1985 | Parque | 269/21 |
| 5,031,293 | 7/1991 | Goedderz et al. | 29/235 |

FOREIGN PATENT DOCUMENTS

| | | | |
|---|---|---|---|
| 71950 | 12/1950 | Denmark | 248/362 |

*Primary Examiner*—Robert C. Watson
*Attorney, Agent, or Firm*—Weiser & Associates

[57] ABSTRACT

An articulated fastening element (1) for use on a workbench, a machine bed, a vacuum table or the like, is composed of a flexible seal (2) which includes, in order to raise a workpiece to a predetermined height H, rigid raising elements (3) distributed over at least one of the side walls of the seal (2) and separated from each other by functional clearances enabling the fastening element (1) to be sharply bent.

19 Claims, 2 Drawing Sheets

ARTICULATED FASTENING ELEMENT

BACKGROUND OF THE INVENTION

The present invention relates to an articulated fastening element for use on a workbench, a machine bed, a vacuum table or the like.

Currently, machines are known for machining, the cutting of wood or for other purposes, these machines being equipped with vacuum tables. These tables are grooved with a predetermined pitch and a rubber seal inserted into the grooves of the table enables an area to be defined on which a workpiece is held in place by means of vacuum through holes in the table. The major drawback of the device is that it does not enable the workpiece to be raised up, and therefore some types of work are not possible such as, for example, the drilling of the workpiece.

A sealing system in the form of a grid or grid pattern, described in document DE-2,258,007, is also known. It is made of rubber and undergoes compression when the workpiece is sucked down. This device therefore does not allow a workpiece to be raised accurately to a predetermined level, and therefore some types of work are not allowed. In addition, it is not articulated nor can it be matched to the shape of a workpiece.

Moreover, it is known to raise the height of the workpiece, while ensuring sealing, by means of templates.

However, these templates require labor in order to be produced and installed, and they are therefore costly. In addition, a template corresponds to a fixed workpiece profile and it is necessary to produce a template for each new type of workpiece, which leads to significant production and material costs and to storage problems.

SUMMARY OF THE INVENTION

The object of the invention is to remedy the foregoing drawbacks. The improved articulated fastening element of the present invention finds utility in conjunction with grooved vacuum tables, as well as smooth tables.

More particularly, the invention is comprised of an articulated fastening element for use on a workbench, a machine bed, a vacuum table or the like, which is composed of a flexible seal which includes, in order to raise a workpiece to a predetermined height (H), rigid raising elements distributed over the length of the seal and separated from each other by functional clearances enabling the fastening element to be sharply bent.

These raising elements are, non-limitingly, studs arranged in pairs symmetrically on either side of the flexible seal, two consecutive studs being separated by a functional gap.

These studs have, non-limitingly, a cross-section in the form of an isosceles right-angled triangle with an upper groove and a lower prolongation beyond which the flexible seal extends.

BRIEF DESCRIPTION OF THE DRAWINGS

The invention will be better understood with the aid of the description below, given with reference to the following appended figures.

DETAILED DESCRIPTION OF PREFERRED EMBODIMENTS

Figure 1:
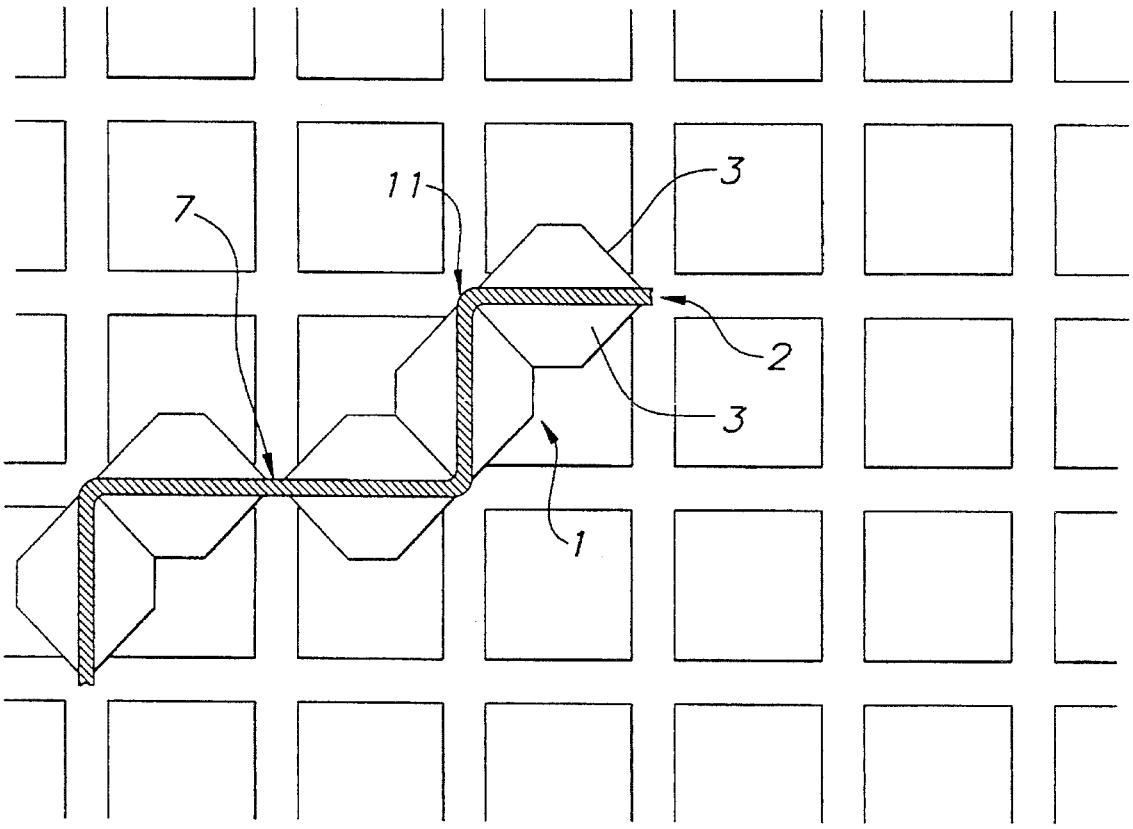
FIG. 1 is a plan view of the articulated seal according to the invention.
Figure 2:
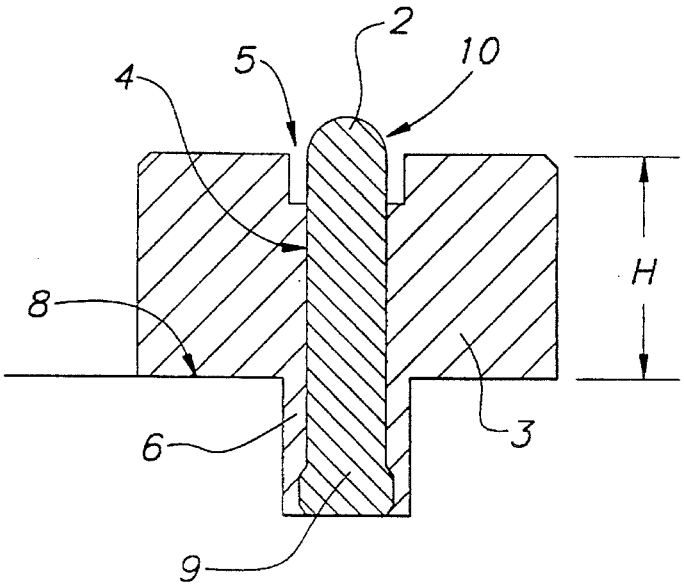
FIG. 2 is a vertical sectional view of the articulated seal according to the invention.

The articulated seal (1) is composed of a flexible seal (2), made of foam for example, to the side walls of which identical studs (3), symmetrically arranged in relation to the foam seal (2), are adhesively bonded.

According to a non-limiting embodiment of the invention, each stud (3) has a horizontal cross-section in the form of an isosceles right-angled triangle, the 90° apex of which is cut and the hypotenuse of which is adhesively bonded to the foam seal (2). The height (H) of the stud corresponds to the height to which it is desired to raise up the workpiece. The face (4) of the stud (3) applied against the seal includes, in its upper portion, a longitudinal groove (5) enabling the top of the seal to be compressed by the workpiece, and further includes a longitudinal prolongation (6) intended to enter a groove of the table.

The studs are arranged in groups of two, face to face, over the entire length of-the foam seal (2). Two groups of studs are separated from each other by a functional gap (7) designed to enable the articulated seal (1) to be sharply bent.

In order to use the seal according to the invention, for example on a grooved table, the vacuum area is defined, chosen as a function of the shape of the workpiece, by inserting it via its prolongations (6) into the grooves of the table. The bases (8) bear on the upper planes of the table. The lower projecting portion (9) is compressed in a channeled bottom for the lower sealing.

The prolongations (6) produce the blocking.

The upper projecting portion (10) will be compressed by the workpiece for producing an upper seal. At a corner, such as (11), two side faces of two successive studs bear on each other by virtue of their 45° inclination in relation to the foam seal (2).

A first end closes the area (see for example, FIG. 3) and any surplus (as far as the second end) is placed inside the area.

This articulated seal enables:

- a workpiece to be raised by a height (H) corresponding to the edge of the studs;
- a workpiece to be raised by the desired height by choosing an articulated seal of appropriate height;
- the vacuum area to be defined as required;
- the vacuum area to be matched to any workpiece profile.

It will be noted that other shapes of studs are possible, for example studs or semicircles separated by a functional gap sufficient for two consecutive studs of a sharp bend (11) to be in contact with each other. If appropriate to a particular application, the grooves (5), the prolongation (6) and the projecting portions (9) (10) may be dispensed with and the raising elements or studs (3) may be arranged on only one of the two side faces of the seal (2).

Figure 3:
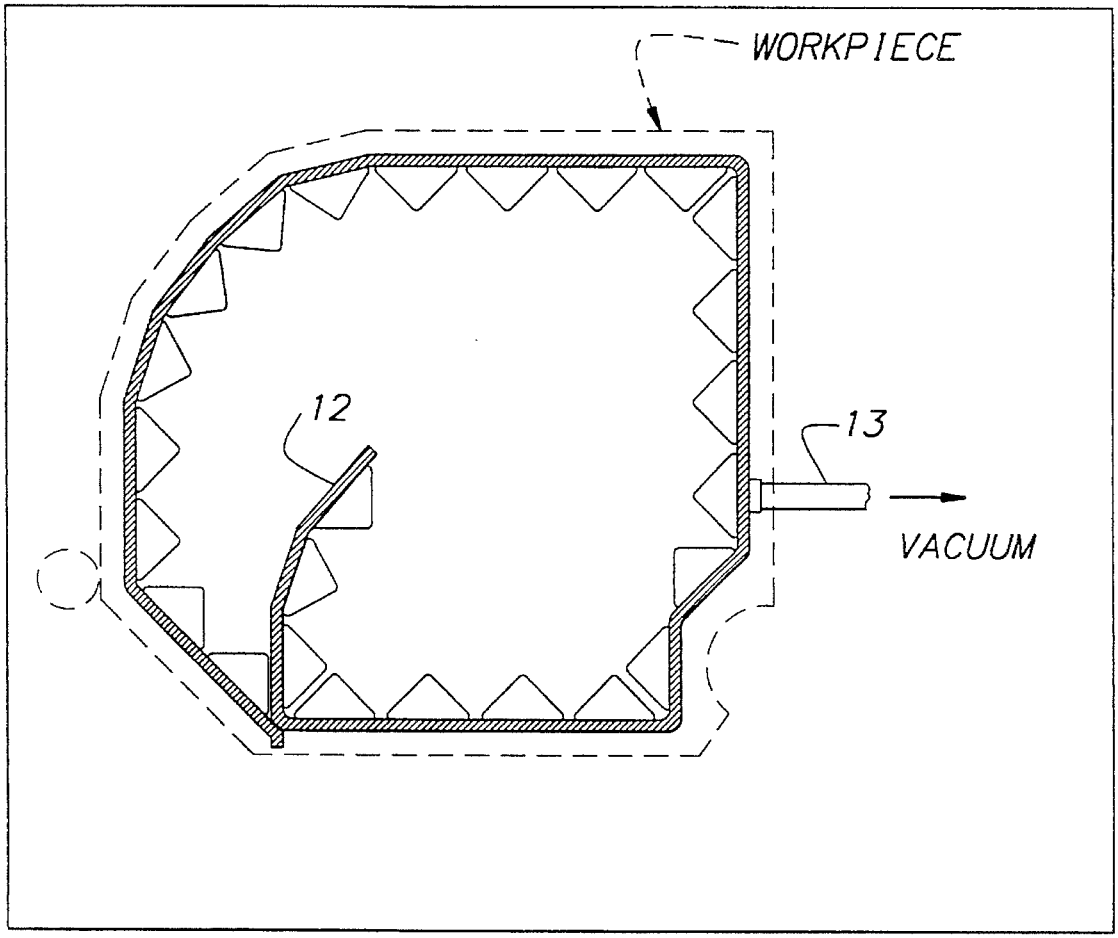
FIG. 3 is an elevational view illustrating use of the invention.
Figure 4:
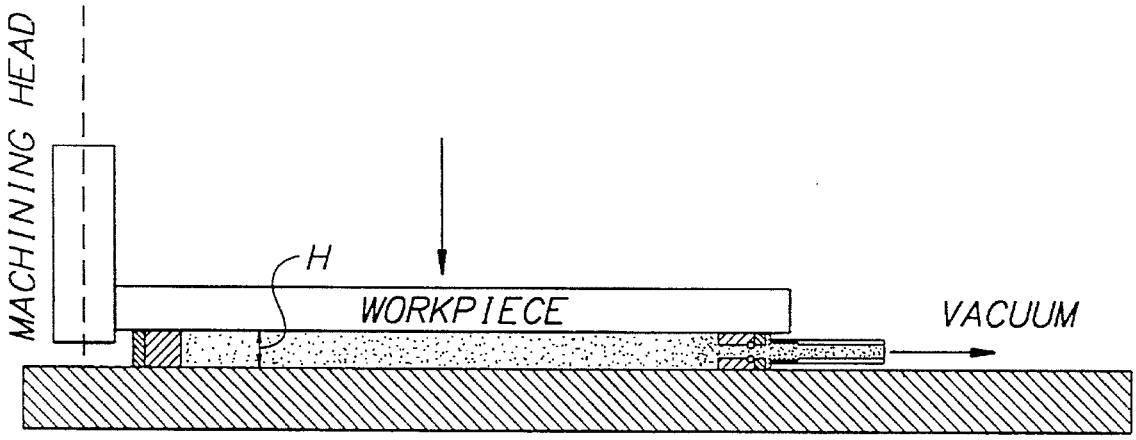
FIG. 4 is a sectional view of FIG. 3, as viewed from the top.

By way of example of use on a smooth table, reference will be made to FIGS. 3 and 4. The height of the seal (2) is substantially that of the elements, (H), for raising a workpiece. The articulated seal is given the shape matched to that of the workpiece. The surplus (12) not equipped with studs ensures sealing on the first stud. This variant may be used on a smooth metallic or magnetic table in association with magnetic or metallic studs.

In both cases, magnetism is used to keep the seal in place between two workpiece changes and to prevent the closed area from retracting under the effect of a vacuum supplied via the suction orifice (13).

I claim:

1. An articulated fastening element for use on a support surface such as a workbench, a machine bed or a vacuum table, for raising a workpiece to a predetermined height above the support surface, comprising a flexible seal having opposing side walls, and a plurality of studs symmetrically arranged in pairs on the opposing side walls of the flexible seal, wherein adjacent studs are separated from each other by a clearance defining a functional gap for enabling the fastening element to be sharply bent, and wherein the studs have a horizontal cross-section in the form of an isosceles right-angled triangle with a cut apex.

2. The articulated fastening element of claim 1 wherein the studs further include an upper groove for receiving the flexible seal in a compressed condition.

3. The articulated fastening element of claim 2 wherein the flexible seal is formed of a foam and includes a projecting portion for compression into the upper groove.

4. The articulated fastening element of claim 1 which further includes a prolongation depending from the fastening element, for engaging a groove in the support surface.

5. The articulated fastening element of claim 4 wherein the flexible seal includes a projecting portion for compression within the groove in the support surface.

6. The articulated fastening element of claim 1 wherein the studs are made of a metal, for association with a magnetic support surface.

7. The articulated fastening element of claim 1 wherein the studs are made of a magnetic material, for association with a metallic support surface.

8. The articulated fastening element of claim 1 wherein the flexible seal has a height, and wherein the studs have a height which substantially corresponds to the height of the flexible seal, for association with a smooth support surface.

9. An articulated fastening element for use on a support surface such as a workbench, a machine bed or a vacuum table, for raising a workpiece to a predetermined height above the support surface, comprising a flexible seal having opposing side walls, and a plurality of rigid raising elements arranged on at least one of the opposing side walls of the flexible seal, wherein adjacent rigid raising elements are separated from each other by a clearance defining a functional gap for enabling the fastening element to be sharply bent, wherein the flexible seal is capable of forming a sealed hollow cavity between the workpiece and the support surface, and wherein the rigid raising elements are capable of supporting the workpiece over the sealed hollow cavity defined by the flexible seal.

10. The articulated fastening element of claim 9 wherein the rigid raising elements further include an upper groove for receiving the flexible seal in a compressed condition.

11. The articulated fastening element of claim 10 wherein the flexible seal is formed of a foam and includes a projecting portion for compression into the upper groove.

12. The articulated fastening element of claim 9 which further includes a prolongation depending from the fastening element, for engaging a groove in the support surface.

13. The articulated fastening element of claim 12 wherein the flexible seal includes a projecting portion for compression within the groove in the support surface.

14. The articulated fastening element of claim 9 wherein the rigid raising elements are made of a metal, for association with a magnetic support surface.

15. The articulated fastening element of claim 9 wherein the rigid raising elements are made of a magnetic material, for association with a metallic support surface.

16. The articulated fastening element of claim 9 wherein the flexible seal has a height, and wherein the rigid raising elements have a height which substantially corresponds to the height of the flexible seal, for association with a smooth support surface.

17. The articulated fastening element of claim 9 wherein the rigid raising elements are a plurality of studs fixed to said one of the opposing side walls.

18. The articulated fastening element of claim 17 which further includes rigid raising elements fixed to both of the opposing side walls of the flexible seal.

19. The articulated fastening element of claim 17 wherein the studs have a horizontal cross-section in the form of an isosceles right-angled triangle with a cut apex.

* * * * *